US007168104B2

(12) United States Patent
Tobergte

(10) Patent No.: US 7,168,104 B2
(45) Date of Patent: Jan. 30, 2007

(54) FOOTBALL SHOULDER PADS

(75) Inventor: Edward H. Tobergte, Fairfield, OH (US)

(73) Assignee: Ed Tobergte Associates Company, Hilton Head Island, SC (US)

( * ) Notice: Subject to any disclaimer, the term of this patent is extended or adjusted under 35 U.S.C. 154(b) by 117 days.

(21) Appl. No.: 10/692,437

(22) Filed: Oct. 23, 2003

(65) Prior Publication Data

US 2005/0086728 A1 Apr. 28, 2005

(51) Int. Cl.
*A41D 13/00* (2006.01)

(52) U.S. Cl. ..... 2/459

(58) Field of Classification Search ..... 2/455, 2/456, 462–465, 467, 410–411, 414, 459, 2/68, 20, 22, 24, 16, 2.5, 92, 102, 909, 69, 2/70, 227, 267, 268, 460–461
See application file for complete search history.

(56) References Cited

U.S. PATENT DOCUMENTS 2,266,886 A * 12/1941 McCoy ..... 2/22
4,486,901 A * 12/1984 Donzis ..... 2/462
4,513,449 A * 4/1985 Donzis ..... 2/462
5,701,611 A 12/1997 Rector et al.
5,781,935 A * 7/1998 Bassett et al. ..... 2/455
5,920,915 A 7/1999 Bainbridge et al.
6,032,300 A 3/2000 Bainbridge et al.
6,336,220 B1 * 1/2002 Sacks et al. ..... 2/22
6,845,522 B2 * 1/2005 Beland ..... 2/461
6,880,269 B2 * 4/2005 Falone et al. ..... 36/44

OTHER PUBLICATIONS

Bike Athletic Company, Catalog, Oct. 2002, pp. 2-8.

* cited by examiner

*Primary Examiner*—Tejash Patel
(74) *Attorney, Agent, or Firm*—Chase Law Firm, L.C.

(57) ABSTRACT

Breathable, lightweight football shoulder pads include left and right torso pads which present a foam body. The foam body includes a hard inner layer, and first and second layers of breathable, lightweight foam secured to opposing surfaces of the hard, inner layer. The layers present a sandwich configuration. A breathable, lightweight fabric layer, such as mesh, extends around the periphery of the foam body. The hard inner layer includes spaced apart openings which allow air or moisture to flow through the foam body.

The football shoulder pads can include adjustable and selectively removable cap pads attachable to the shoulder portion of the football pads. The cap pads include a member for securing the cap pad to the wearer's arm. The football shoulder pads can further include adjustable and selectively removable deltoid pads and attachments for securing football pad accessories, such as a neck roll or rib protector, to the shoulder pads.

22 Claims, 5 Drawing Sheets

FOOTBALL SHOULDER PADS

FIELD OF THE INVENTION

This invention relates to an improved athletic protective pad construction that is lightweight and breathable. Additionally, the invention relates to football shoulder pads having improved, removable cap pads as well as additional removable pads at the shoulder portion of the pads and removable deltoid pads.

BACKGROUND OF THE INVENTION

Athletic protective pads, such as shoulder pads, rib protectors, hip pads, thigh pads, and so forth, are commonly worn by athletes in a variety of sports in which body contact with either another participant or a piece of equipment used in the sport presents the risk of injury. These types of protective pads have long been known and used by athletes in contact sports such as football and hockey.

Football shoulder pads typically include a relatively hard outer shell of leather, rigid plastic or similar material and an inner layer of soft padding material. The hard outer layer receives the applied force or shock upon impact and spreads the force over a large area where it is absorbed and cushioned by the soft padding material. Padding materials may include cotton padding, foam rubber, foam plastic, sponge rubber, a combination of open and closed cell foams and expanded rubber or vinyl, with the properties of such materials having the ability to reduce the transmitted force during impact.

These and other types of padding typically do not allow body heat to be released and thus, are very warm when worn by an athlete. This can decrease the athlete's level of performance and in extreme cases it can even be a cause of heat stroke. The hard outer shell prevents airflow into and/or perspiration evaporation away from the athlete's body.

Also, the hard outer layer and padding combinations can be very heavy and cumbersome for an athlete. The added weight can also decrease the athlete's performance, especially speed and mobility. Shoulder pads are typically constructed to include padding that extends across an athlete's chest and back area as well as partially across the front and back shoulder region which can restrict the athlete's movement.

In football, different positions require different amounts and areas of body protection. For instance, a wide receiver must be as fast and agile as possible. Although safety is a concern, the less padding the better. The wide receiver prefers lightweight shoulder pads. In contrast, blocking linemen take quite a beating and require more padding protection. Also, an injured player who typically does not require padding in certain areas, such as over the shoulder, upper arm or deltoid area, may need additional padding protection during the injury healing period.

BRIEF SUMMARY OF THE INVENTION

Accordingly, new, improved, breathable, lightweight football shoulder pads are disclosed. The football shoulder pads include selectively removable padding which makes the pads even more lightweight as desired and needed. In contrast, the removable padding can be added to the pads as needed, if a player is injured or playing a position that requires more or less padding.

The football shoulder pads include left and right torso pads which present a foam body. The foam body includes a hard inner layer, and first and second layers of breathable, lightweight foam secured to opposing surfaces of the hard, inner layer. The layers present a sandwich configuration. A breathable, lightweight fabric layer, such as mesh fabric, extends around the periphery of the foam body. The hard inner layer includes spaced apart openings which allow air or moisture to flow through the foam body.

The football shoulder pads can include adjustable and selectively removable cap pads attachable to the shoulder portion of the football pads. The cap pads include a member for securing the cap pad to the wearer's arm. The football shoulder pads can further include adjustable and selectively removable deltoid pads and attachment members for securing football pad accessories, such as a neck roll or rib protector, to the shoulder pads.

DETAILED DESCRIPTION

Figure 1:
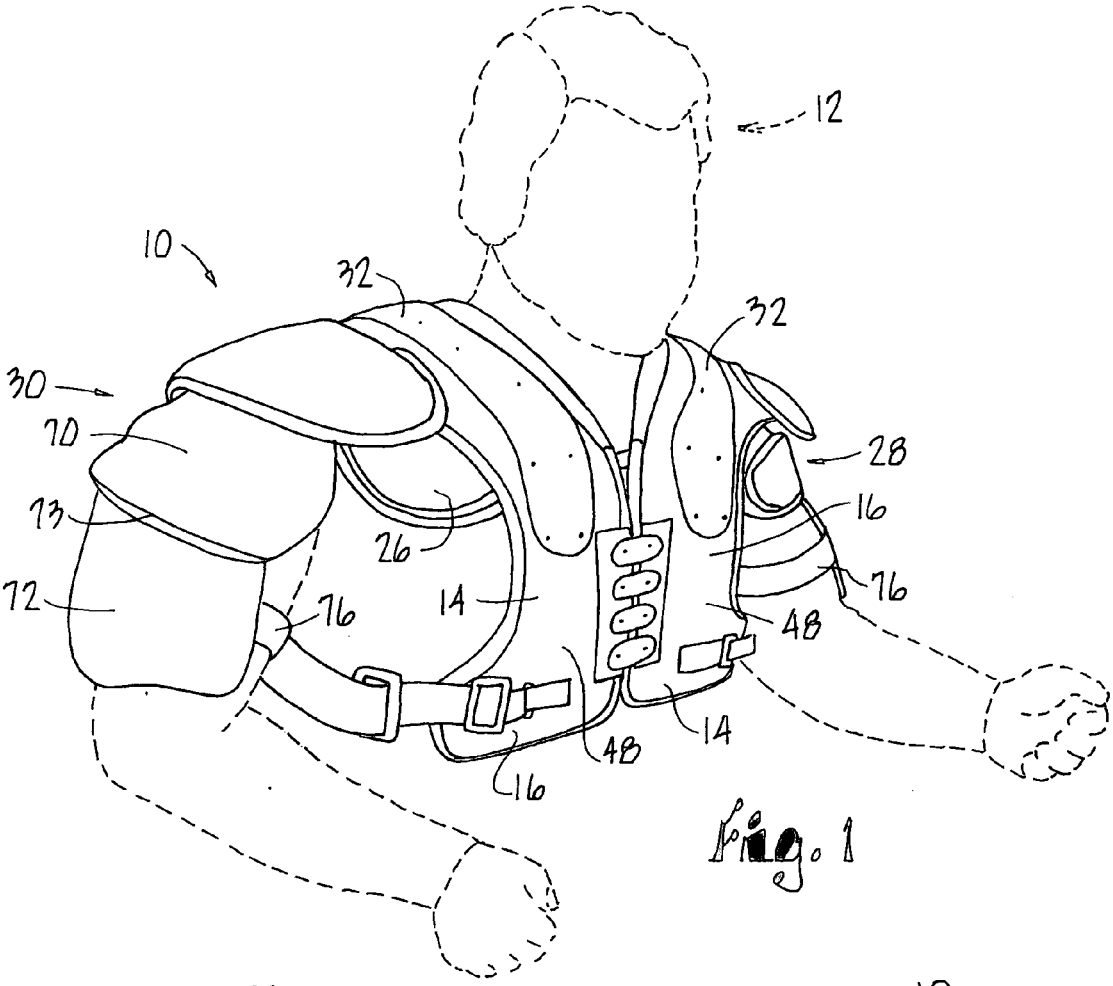
FIG. 1 is a perspective view of football shoulder pads in accordance with the present invention, with the pads' wearer shown in phantom.
Figure 2:
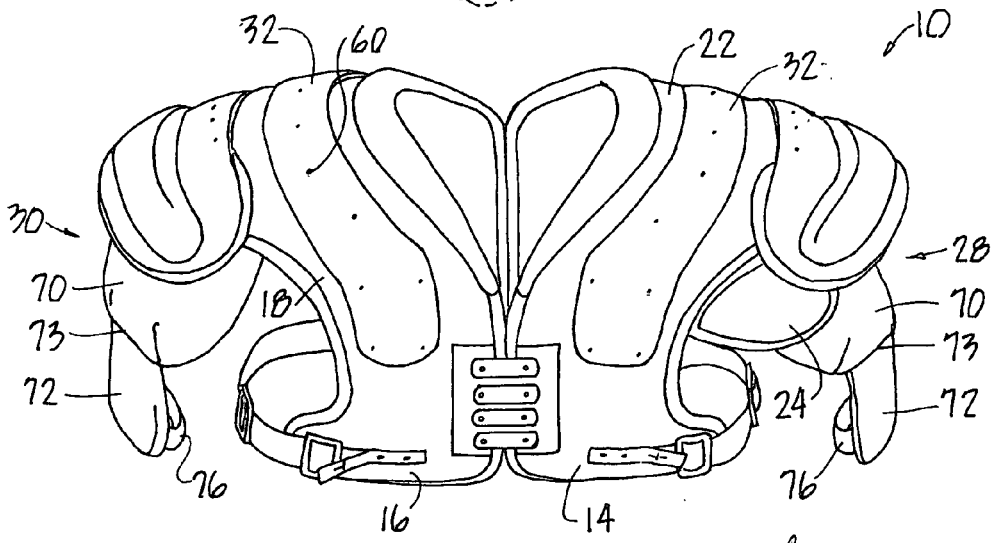
FIG. 2 is a front perspective view of the football shoulder pads of FIG. 1, showing the right deltoid pad removed therefrom.
Figure 3:
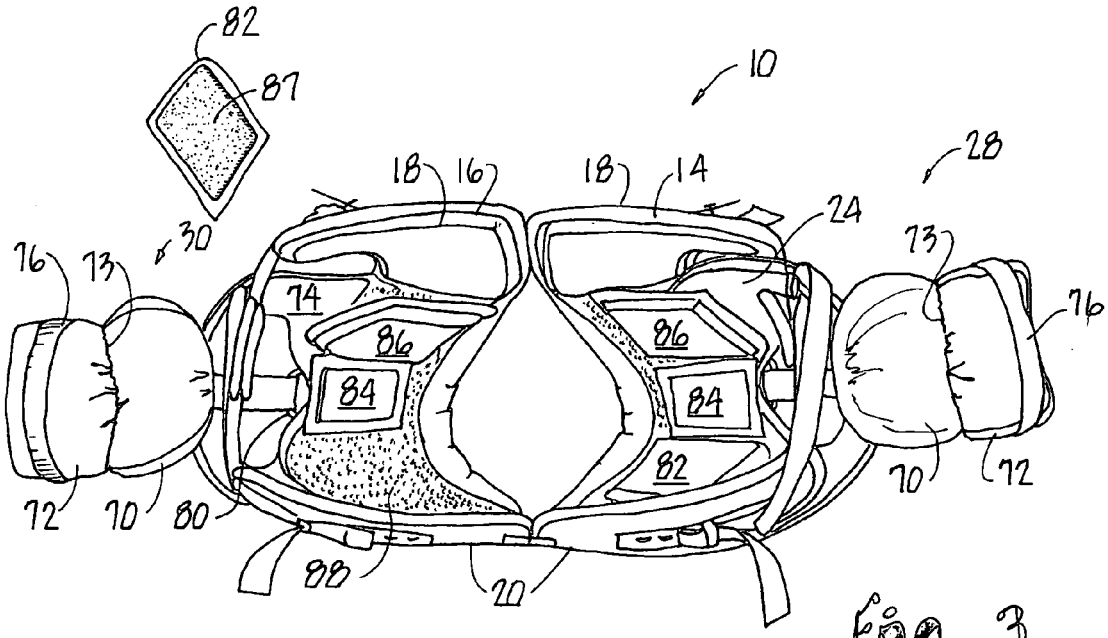
FIG. 3 is a bottom perspective view of the football shoulder pads of FIG. 1, showing a clavicle pad removed therefrom.

Football shoulder pads 10 in accordance with the present invention are shown as worn by an athlete 12 in FIG. 1. As seen in FIGS. 1–3, to sufficiently protect the athlete's upper torso, the shoulder pads 10 include left and right torso halves 14 and 16. Each half is identical but a mirror image of the other and includes a chest portion 18, back portion 20 and shoulder portion 22. The pads 10 additionally include left and right deltoid pads 24 and 26 and left and right shoulder cap pads 28 and 30. A rigid plastic outer arch 32 extends partially over the exterior of each torso half 14 and 16 to provide stability to the shoulder portions 22.

Figure 12:
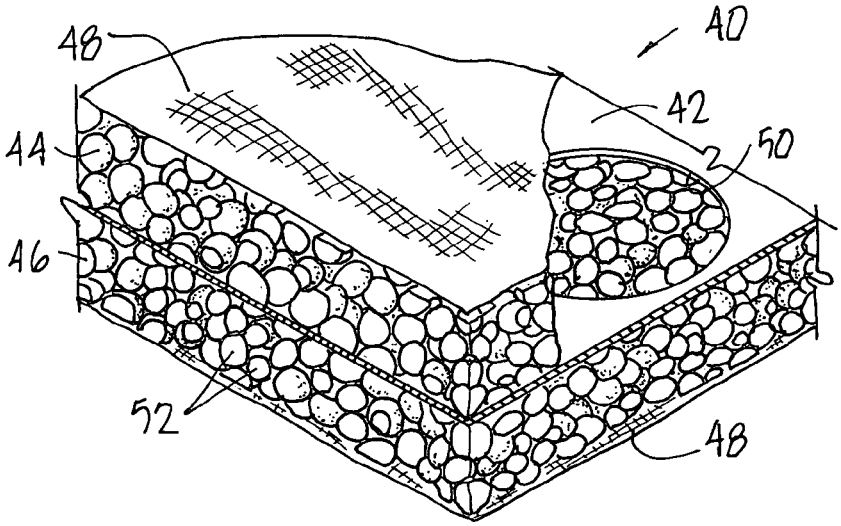
FIG. 12 is an enlarged fragmentary cross-sectional view of the football shoulder pads' foam body.
Figure 13:
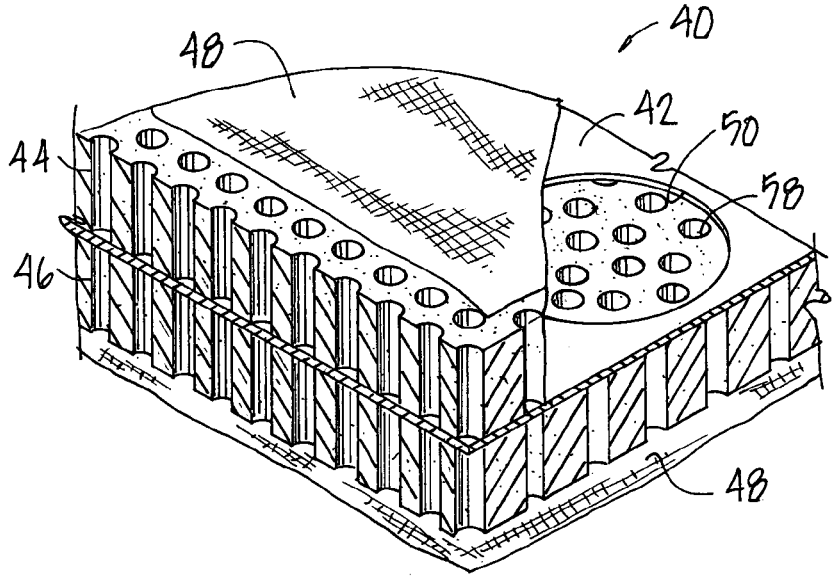
FIG. 13 is an enlarged fragmentary cross-sectional view of a second alternative embodiment of the foam body.

The torso halves 12 and 16 present a foam body 40, portions of which are shown in FIGS. 12 and 13. Although the foam body 40 is shown and described in connection with football shoulder pads, this foam body construction can be used in protective padding equipment or athletic wear for other sports, such as baseball, hockey, lacrosse, etc. or other types of pads, such as hip, thigh or rib protectors. For instance, the foam body 40 could be used for baseball chest protectors or leg guards.

The foam body 40 includes a hard inner layer 42 and first and second layers 44 and 46 of breathable foam. The first and second layers 44 and 46 are secured to opposing surfaces of the hard inner layer 42 presenting a sandwich configuration. Any suitable adhesive can be used to secure the layers together. Preferably, a glue is applied to the surfaces of the inner layer 42 and the layers are laminated. A breathable fabric, preferably mesh 48, extends around the periphery of the foam body 40.

Figure 11:
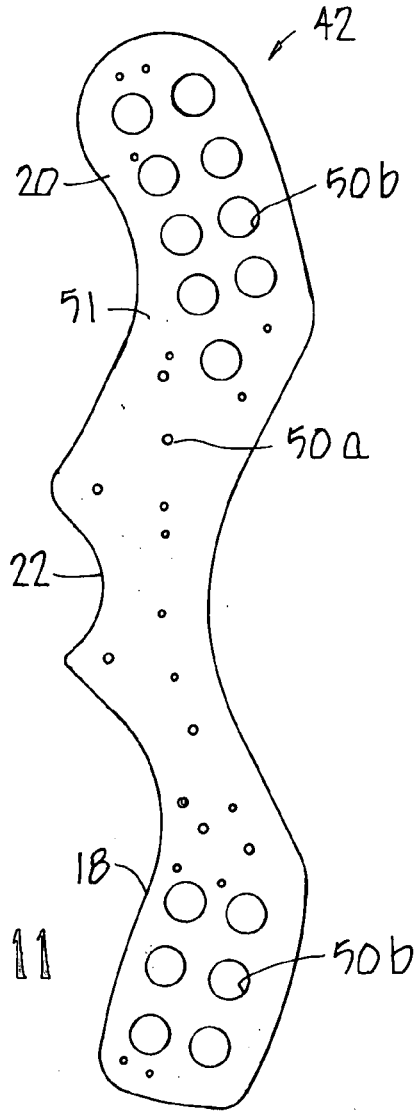
FIG. 11 is a top view of the hard inner layer of the football shoulder pads.

The hard, inner layer 42, as shown in detail in FIG. 11, is formed of a piece of rigid plastic with spaced apart openings 50*a* and 50*b* stamped therethrough. Layer 42 can be formed of other suitable hard, impact resistant materials, such as leather. FIG. 11 shows the plastic layer 42 which is used in one of the torso halves 14 or 16. Thus, when adhered between the foam layers 44 and 46 to form the football pads 10, the layer 42 presents a chest portion 18, back portion 20 and shoulder portion 22 that corresponds to the left or right torso half 14 or 16. The plastic layer 42 is preferably 2.6 millimeters thick. The number and size of the openings 50 can vary depending on the size of the shoulder pads 10. However, preferably the openings 50*a* over the shoulder portion 22 are 8 millimeters in diameter and the openings 50*b* over the chest and back portions 18 and 20 are 25–28 millimeters in diameter.

As seen in FIG. 12, the first and second foam layers 44 and 46 are formed of closed cell foam beads 52 fused together where the individual beads 52 meet. One such foam is Brock™ foam which is disclosed in U.S. Pat. Nos. 5,920,915 and 6,032,300. These patents are hereby incorporated herein by reference. This foam circulates air in three dimensions. As the body sweats, the sweat coats the beads which actually accelerates evaporation, body cooling and drying. Upon impact, each bead tries to separate the adjacent beads sideways, deflecting the energy away from the body and thereby absorbing more impact than foams of comparable weight and flexibility.

Alternatively, as shown in FIG. 13, the first and second foam layers 44 and 46 can be conventional open or closed cell foams, each layer being punctured with multiple puncture holes 58 therethrough. One layer 44 or 46 could be open cell foam and the other layer 44 or 46 can be closed cell foam to maximize impact resistance to the athlete. The puncture holes 58 are smaller in diameter than the hard layer openings 50. Preferably, several puncture holes 58 align with an opening 50 to allow air and moisture to pass through the foam body 40.

Thus, the foam layers 44 and 46, impact resistant inner layer 42 and mesh 48 are lightweight and cooperate to allow air or moisture to flow through the foam body 40.

The outer arches 32, as seen in FIGS. 1 and 2, extend over the outside surface of the mesh 48 at the shoulder portions 22. The arches 32 are riveted to the shoulder portions 22 of the torso halves 14 and 16. The clearance between the first outer foam layer 44 and the outer arches 32 allows air or moisture to flow or disperse through this area of the shoulder pads 10. However, because of the tight or small clearance between the outer arches 32 and the torso halves 14 and 16, accessory attachments 60 are preferably secured to each outer arch 32. See FIG. 2. Two other attachments (not shown) are positioned opposite the attachments 60 shown in FIG. 2 but on the back portions 20.

Figure 10:
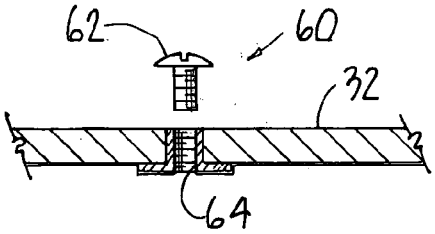
FIG. 10 is an enlarged fragmentary cross-sectional view of an alternative accessory connection on the shoulder pads of FIG. 1.

The accessory attachments 60 allow shoulder pad accessories, such as neck rolls (not shown) which are more typically worn by lineman, to be easily attached to the shoulder pads 10 as necessary. As seen in FIG. 10, each accessory attachment 60 includes a screw 62 extending through the outer arch 32 and secured thereto by t-nut 64, which extends into the outer arch 32 from its inner surface.

Figure 9:
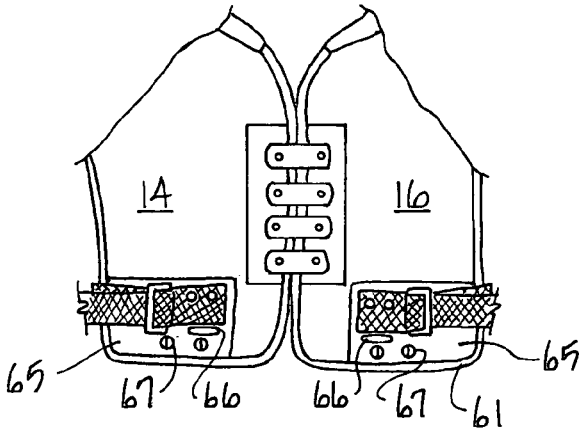
FIG. 9 is a partial back or rear view of football shoulder pads in accordance with the present invention, showing an accessory attachment thereon.

The attachments 60 may not be necessary on shoulder pads designed to be worn by other players such as quarterbacks or wide receivers. These other positions, however, are more likely to need additional protection elsewhere, for instance over the ribs. FIG. 9 shows a partial rear view of a quarterback version of the shoulder pads 10. These pads preferably do not include accessory attachments 60 but include accessory attachments 61.

The accessory attachments 61 include extruded vinyl or plastic flaps 65 riveted across the length thereof and adjacent each flap's top edge through the outer foam layer 44 to the inner plastic layer 42 with slots 66 and/or holes 67 therethrough. The accessory, such as a rib protector (not shown), is secured to the attachments 61 by hooking it within the slots 66 and/or holes 67. An attachment 61 is positioned adjacent the lower edge of each torso half 14 and 16.

Next, some football positions require more padding than others, such as the offensive and defensive line positions. As seen in FIGS. 1–4, the shoulder pads 10 include adjustable and removable cap pads 28 and 30. As shown the cap pads 28 and 30 each have an upper cap portion 70 and a lower cap portion 72. However, other shoulder pad models, such as quarterback shoulder pads, may only include cap pads having an upper cap portion 70. Given the cap pads' removability, these different types of cap pads are also interchangeable between shoulder pads.

The cap portions 70 and 72 are each discrete pads, but are covered by the same nylon covering. The covering is stitched together between the cap portions 70 and 72 to present a hinge 73. The lower cap portion 72 is substantially trapezoidal and includes a lower elastic strap 76 which extends across the width of the lower cap portion 72 from one side thereof to the other side adjacent the free end of the lower cap portion 72. The ends of the elastic strap 76 are stitched to the lower cap portion's nylon covering. The elastic strap 76 wraps around the athlete's upper arm to maintain the cap pads 28 and 30 in position over the athlete's upper arm. See FIG. 1. Thus, the cap pads 28 and 30 can be secured to the athlete's upper arm to ensure the padding moves with the arm regardless of the direction of movement.

Figure 4:
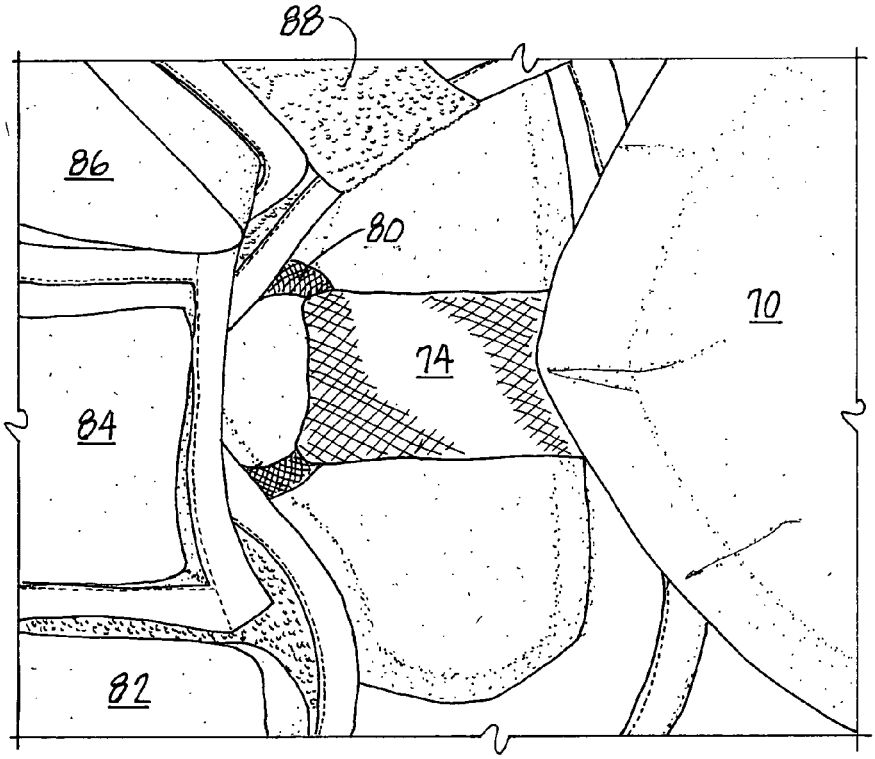
FIG. 4 is an enlarged partial bottom or inside view of the football shoulder pads of FIG. 1 showing the releasable connection of a cap pad to the football shoulder pads in detail.
Figure 5:
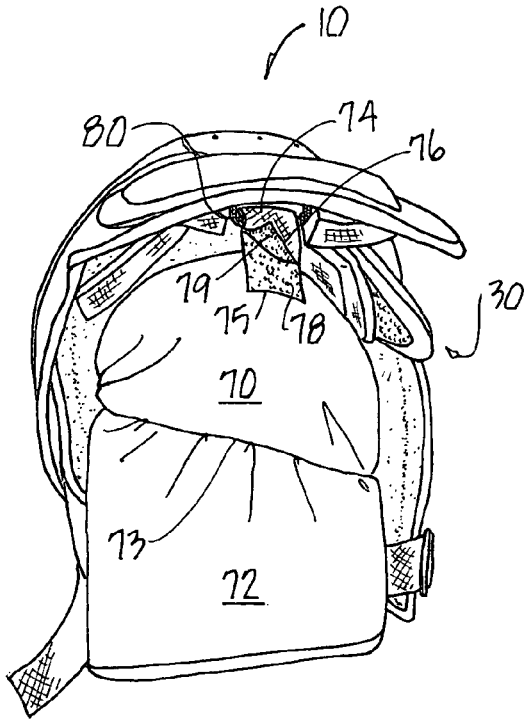
FIG. 5 is a side perspective view of the football shoulder pads of FIG. 1 with the cap pad strap turned up to show its adjustability.

The upper cap portions 70 are releasably and adjustably secured to the shoulder portions 22 of the football pads 10 and help protect the athlete's shoulders. As seen in FIGS. 3–5, an upper strap 74 extends outwardly from the center of the top edge of each upper cap portion 70. Thus, the upper strap 74 has one secured end 75 stitched to the upper cap portion 70 and another free end 76. The top surface of each strap 74 has hook and loop tape, such as Velcro™, thereon. More specifically, a length of hook tape 78 extends from the secured end 75 along the strap's top surface and a shorter length of loop tape 79 is secured at the free end 76 of the strap's top surface as best shown in FIG. 5.

A loop 80 is stitched to each torso half 14 and 16 at the shoulder portion 22 thereof. The free end 76 of the strap 74 extends outwardly from the upper cap portion 70 through loop 80 into hook and loop attachment to itself. The length or position of the cap pads 28 and 30 can be adjusted by securing the loop tape 79 in different places along the length of the hook tape 78. For instance, the cap pad 30 shown in FIG. 5 could be raised (or shortened) by pulling more length if the strap 74 through the loop 80 and securing the tape's free end 76 over the tape's secured end 75. This adjustability allows the same cap pads 28 and 30 to be used with different sized players. By releasing the strap's hook and loop attachment, the cap pads 28 and 30 can be removed from the shoulder pads 10.

Football shoulder pads 10 also allow for additional padding over the shoulder area. Under each shoulder portion 22 of the torso halves 14 and 16 is a set or series of clavicle pads. See FIGS. 3 and 4. Each set includes three distinct pads 82, 84 and 86. Each distinct pad 82, 84 and 86 is selectively removable or adjustable through the use of hook and loop type tape, such as Velcro,™ as desired, depending on the placement and amount of padding required in this area. FIG. 3 shows the left side pad 82 removed from the shoulder pads 10. The bottom of each pad 82, 84 and 86 is covered with loop tape 87 and an area of hook tape 88 is stitched to the mesh 48 at the bottom surface of the shoulder portions 22 of the shoulder pads 10. These pads 82, 84 and 86 are preferably the Air Release™ type with a foam body similar to that disclosed in U.S. Pat. No. 5,701,611, which is hereby incorporated herein by reference. In these football pads 10, the Air Release™ type pads have an open cell center layer that is 12 millimeters thick sandwiched between two outer layers of closed cell foam that are 3 millimeters thick.

Figure 6:
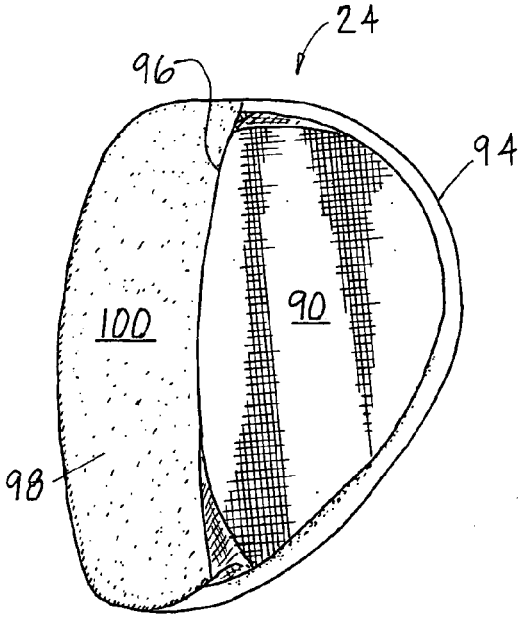
FIG. 6 is an enlarged front view of the left deltoid pad removed from the shoulder pads.
Figure 7:
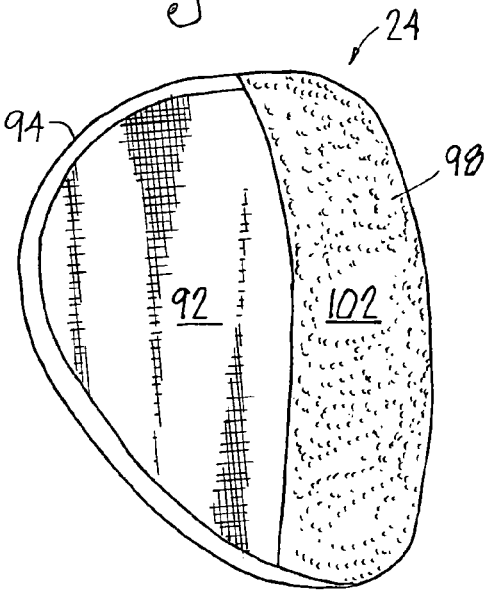
FIG. 7 is a rear plan view of the deltoid pad of FIG. 6.

The football shoulder pads 10 also have selectively removable, adjustable left and right deltoid pads 24 and 26. The deltoid pads 24 and 26 are mirror images of each other. Only one will be discussed in detail. As seen in FIGS. 6 and 7, the left deltoid pad 24 includes an outer or top surface 90, a rear surface 92, a curved outer side 94 and an inner side 96. An attachment flap 98 extends outwardly from the rear surface 92 along the length of inner side 96. The flap 98 preferably has a width of approximately 1¾". The flap 98 has a top surface 100 and a bottom surface 102. The top surface 100 is covered with loop tape and the bottom surface 102 is covered with hook tape.

Figure 8:
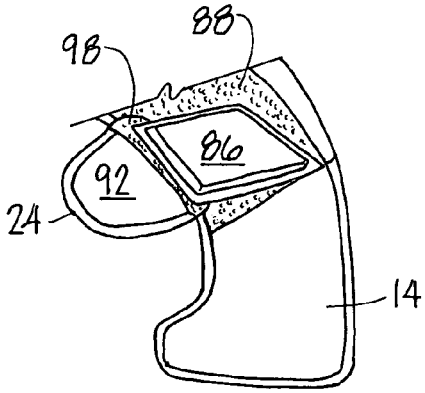
FIG. 8 is a partial bottom or inside view of the shoulder pads of FIG. 1 sowing the overlap between a clavicle pad and a deltoid pad.

As shown in FIG. 8, each deltoid pad 24 and 26 is secured to the shoulder pads 10 by sticking the loop tape of the flap's top surface 100 to the hook tape 88 of the shoulder pads 10. The position of each deltoid pad 24 and 26 can be adjusted along the length of the flap 98 and across the width of the flap 98. A clavicle pad 86 can then be secured over each deltoid pad's hook tape on the flap's bottom surface 102, sandwiching the deltoid pads 24 and 26 between a clavicle pad 86 and the shoulder pads 10.

Thus, the football shoulder pads 10 are lightweight and breathable, but can be augmented to include additional adjustable padding in the shoulder, upper arm and deltoid areas, as desired.

It is to be understood that while certain forms of this invention have been illustrated and described, it is not limited thereto except insofar as such limitations are included in the following claims and allowable equivalents thereof.

The invention claimed is:

1. Football shoulder pads, comprising:

a left and right torso pad, each including a front portion, a back portion and a shoulder portion, a left and right cap pad extending from said shoulder portion of said corresponding torso pad;

said torso pads being breathable and including a foam body having a hard inner layer and first and second layers of breathable foam secured to opposing surfaces of said hard inner layer, said layers presenting a sandwich configuration, said hard inner layer having spaced apart openings therethrough to allow airflow through said torso pads substantially throughout their area;

each said cap pad having a first means for releasably securing an upper end thereof to said corresponding shoulder portion and a second means for releasably securing each cap pad at a lower end thereof to a wearer's arm;

said first means extending from an upper portion of each said cap pad;

said second means extending from a lower portion of each said cap pad;

each said cap pad thereby providing protection to the wearer's shoulder and arm with movement thereof in any direction.

2. Football shoulder pads as claimed in claim 1 wherein said means for securing said cap pad to a wearer's arm includes a strap, the ends of said strap secured to opposite sides of said corresponding cap pad and said strap adapted to extend around the wearer's arm.

3. Football shoulder pads as claimed in claim 1 wherein said means for releasably securing each said cap pad at an upper end thereof includes a strap and a loop, said strap attached at one end to said upper end of said cap pad, said loop secured to said shoulder portion, a free end of said strap adapted to extend through said loop into secure engagement with itself.

4. Football shoulder pads as claimed in claim 1 further comprising left and right deltoid pads, one said deltoid pad being selectively removable from said corresponding torso pad.

5. Football shoulder pads as claimed in claim 1, further comprising:

outer arches, one said arch secured over each one of said shoulder portions of said torso pads and having a means for accessorizing the football shoulder pads secured thereto.

6. Football shoulder pads as claimed in claim 1 further comprising:

a means for accessorizing the football shoulder pads secured to said torso pads.

7. Football shoulder pads as claimed in claim 1 wherein said layers of breathable foam are formed of closed cell foam beads fused together.

8. Football shoulder pads as claimed in claim 1 where said layers of breathable foam include spaced apart perforations therethrough with at least one said perforation in alignment with one said opening in said hard, inner layer.

9. Football shoulder pads as claimed in claim 5 wherein said means for accessorizing includes a t-nut secured within an aperture extending through each said outer arch and a screw secured to each said t-nut and adapted to receive and secure an accessory to the football shoulder pad.

10. Football shoulder pads as claimed in claim 6 wherein said means for accessorizing includes a flap having an aperture therethrough, adapted to receive and secure an accessory to the football shoulder pads.

11. Football shoulder pads, comprising:

a breathable torso pad member of said shoulder pads having a front portion, a back portion and a shoulder portion;

said breathable torso pad member further including a foam body having a hard, inner layer and first and second layers of breathable foam secured to opposing surfaces of said hard inner layer, said layers presenting a sandwich configuration;

said hard inner layer having spaced apart openings therethrough to allow airflow through said torso pad member substantially throughout its area.

12. Football shoulder pads as claimed in claim 11 further comprising:

an adjustable cap pad extending from said shoulder portion;

means for releasably securing said cap pad at said shoulder portion.

13. Football shoulder pads as claimed in claim 11 further comprising:

an adjustable cap pad extending from said shoulder portion;

means for securing said cap pad to a wearer's arm, said cap pad thereby providing protection to the wearer's arm with movement thereof in any direction.

14. Football shoulder pads as claimed in claim 11, further comprising:

a deltoid pad selectively removable from said front portion.

15. Football shoulder pads as claimed in claim 11, further comprising:

an outer arch secured over said shoulder portion and having a means for accessorizing the football shoulder pads secured to said outer arch.

16. Football shoulder pads as claimed in claim 11, further comprising:

a means for accessorizing the football shoulder pads secured to said torso pad member.

17. Football shoulder pads as claimed in claim 11 wherein said layers of breathable foam are formed of closed cell foam beads fused together.

18. Football shoulder pads as claimed in claim 11 wherein said layers of breathable foam include spaced apart perforations therethrough with at least one said perforation in alignment with one said opening in said hard, inner layer.

19. Football shoulder pads as claimed in claim 11 wherein said hard, inner layer is plastic.

20. Football shoulder pads as claimed in claim 12 wherein said means for releasably securing said cap pad at said shoulder portion includes a strap and a loop, said strap attached at one end to said cap pad, said loop secured to said shoulder portion, a free end of said strap adapted to extend through said loop into secure engagement with itself.

21. Football shoulder pads as claimed in claim 13 wherein said means for securing said cap pad to a wearer's arm includes a strap, the ends of said strap secured to opposite sides of said cap pad, said strap adapted to extend around a wearer's arm.

22. Football shoulder pads, comprising:

a breathable torso pad member having a front portion, a back portion and a shoulder portion, an adjustable cap pad releasably secured to said shoulder portion, and a selectively removable and adjustable deltoid pad; and an accessory attachment member on the football shoulder pads, said attachment member including an aperture extending therethrough adapted to secure an accessory to the football shoulder pads;

said breathable torso pad member further including a foam body having a hard, inner, plastic layer and first and second layers of breathable foam formed of closed cell foam beads fused together;

said layers of breathable foam secured to opposing surfaces of said hard, inner, plastic layer to present a sandwich configuration;

said hard, inner plastic layer having spaced apart openings therethrough to allow airflow through said torso pad member substantially throughout its area;

said cap pad including a strap, the ends of said strap being secured to opposite sides of said cap pad, said strap thereby being adapted to extend around a wearer's arm.

* * * * *